US006997649B1

(12) United States Patent
Saito

(10) Patent No.: US 6,997,649 B1
(45) Date of Patent: Feb. 14, 2006

(54) UNDERWATER RIPRAP FOUNDATION AND CONSOLIDATION SMOOTHING METHOD THEREFOR

(76) Inventor: Kiyoshi Saito, 5-25, Misakicho 2-chome, Muroran-shi, Hokkaido (JP)

( * ) Notice: Subject to any disclaimer, the term of this patent is extended or adjusted under 35 U.S.C. 154(b) by 0 days.

(21) Appl. No.: 11/028,336

(22) Filed: Jan. 4, 2005

(30) Foreign Application Priority Data

Oct. 7, 2004 (JP) ..... 2004-294771

(51) Int. Cl.
*E02D 3/02* (2006.01)

(52) U.S. Cl. ..... 405/271; 405/15; 405/249

(58) Field of Classification Search ..... 405/15, 405/29, 229, 249, 271
See application file for complete search history.

(56) References Cited

U.S. PATENT DOCUMENTS 1,571,446 A * 2/1926 Howells ..... 405/117
1,997,132 A * 4/1935 Felix ..... 405/109
3,526,096 A * 9/1970 Casagrande et al. ..... 405/195.1
3,731,492 A * 5/1973 Ageev et al. ..... 405/117
4,089,183 A * 5/1978 Endo et al. ..... 405/267
4,090,363 A * 5/1978 List et al. ..... 405/109
4,828,431 A * 5/1989 Chen ..... 405/217

FOREIGN PATENT DOCUMENTS

JP 56119012 * 9/1981 ..... 405/30
JP 60040740 * 3/1985 ..... 405/205
JP 2893527 10/1999
JP 3284348 9/2001
JP 2001323467 * 11/2001

* cited by examiner

*Primary Examiner*—Jong-Suk (James) Lee
(74) *Attorney, Agent, or Firm*—Rader, Fishman & Grauer PLLC

(57) ABSTRACT

An underwater riprap foundation which can be constructed efficiently using a reduced amount of ripraps and a consolidation smoothing method for efficient construction of the same are disclosed. The underwater riprap foundation includes a first region for supporting comparatively high load from a structure such as a caisson, and a second region positioned adjacent the first region for supporting comparatively low load from mulch blocks or the like. The first region is formed as a rigid riprap core wall body having a consolidation density higher than that in the second region. The first and second regions have top faces flush with each other. In construction, ripraps are thrown into water such that the extra-banking height in the first region is higher than in the second region, and free fall of a weight is repetitively carried out to the first and second regions to consolidate the ripraps.

3 Claims, 3 Drawing Sheets

UNDERWATER RIPRAP FOUNDATION AND CONSOLIDATION SMOOTHING METHOD THEREFOR

BACKGROUND OF THE INVENTION

1. Field of the Invention

The present invention relates to an underwater riprap foundation and a consolidation smoothing method therefor.

2. Description of the Related Art

Conventionally, an underwater riprap foundation consolidation smoothing method of the weight free fall type is known and used for construction of a mole, a quay or the like. According to the underwater riprap foundation consolidation smoothing method, ripraps are thrown into the water so as to be piled up under the water to form an underwater riprap foundation having a trapezoidal transverse section and a height greater by a required extra-banking height than a planned height for the top end. Further, free fall of a weight is carried out repetitively to consolidate and smooth the underwater riprap foundation to the planned top end height. The underwater riprap foundation consolidation smoothing method is disclosed, for example, Japanese Patent No. 2,893,527 (hereinafter referred to as Patent Document 1) and Japanese Patent No. 3,284,348 (hereinafter referred to as Patent Document 2).

According to the consolidation smoothing described above, within a region of a horizontal portion of the underwater riprap foundation within which a structure such as a caisson which applies a high load is to be supported, in order to prevent possible settlement of the structure by an earthquake or waves, it is necessary to raise the degree of consolidation to sufficiently engage the ripraps with each other until the porosity becomes lower than a fixed level and to finish the underwater riprap foundation with a high degree of accuracy such that the dimensional error of the planned top end height falls within an allowable range of approximately ±5 cm. However, within another range of the same horizontal portion within which only mulch blocks or like elements which provide a low load are to be supported, there is no problem even if the consolidation degree is lower than that where the region in which the load is high, and an error of approximately ±30 cm is permitted. Further, for a face of slope, also an error of approximately ±50 cm is permitted.

However, since conventionally an entire underwater riprap foundation is consolidated to a degree substantially equal to that required for a region in which the load is high and is smoothed to an accuracy substantially equal to that required for the region in which the load is high, also within a region within which the load is low and a face of slope, the underwater riprap foundation is consolidated to an excessively high degree of consolidation and smoothed to an excessively high degree of accuracy uselessly. Thus, the execution efficiency is low and also the cost for construction is high.

Further, that an underwater riprap foundation includes a portion in which ripraps are consolidated to an excessively high degree of consolidation so as to be smoothed to a planned top end height as described above signifies that an excessive amount of ripraps is consumed, which apparently is uneconomical.

Further, since conventionally the extra-banking height is set equal over the overall underwater riprap foundation, when consolidation smoothing in a certain region is to be performed using a weight, ripraps are sometimes forced up to an adjacent region within which the consolidation smoothing is completed already, resulting in the necessity to carry out the consolidation smoothing in the adjacent region again. Also in this regard, the conventional consolidation smoothing is low in efficiency.

SUMMARY OF THE INVENTION

It is an object of the present invention to provide an underwater riprap foundation which can be constructed efficiently using a reduced amount of ripraps.

It is another object of the present invention to provide a consolidation smoothing method by which an underwater riprap foundation can be constructed efficiently.

In order to attain the objects described above, according to an aspect of the present invention, there is provided an underwater riprap foundation, comprising a first region for supporting comparatively high load applied thereto from a structure such as a caisson, and a second region positioned adjacent the first region for supporting comparatively low load applied thereto from mulch blocks or the like, the first region being formed as a rigid riprap core wall body having a consolidation density higher than that in the second region, the first region and the second region having top faces which are flush with each other.

Preferably, the riprap core wall body has upper, middle and lower layers, and the consolidation density of the middle layer is higher than that of the lower layer while the consolidation density of the upper layer is higher than that of the middle layer.

Preferably, the second layer has upper, middle and lower layers, and the consolidation density of the middle layer is higher than that of the of the lower layer while the consolidation density of the upper layer is higher than that of the middle layer.

With the underwater riprap foundation, since the first region for supporting comparatively high load applied thereto from a structure such as a caisson placed thereon is formed as a rigid riprap core wall body having a consolidation density higher than that in the second region positioned adjacent the first region for supporting comparatively low load applied thereto from mulch blocks or the like placed thereon and the first region and the second region have top faces which are flush with each other, a structure placed on the first region and having a high weight can be supported stably without any considerable settlement on the first region.

According to a second aspect of the present invention, there is provided an underwater riprap foundation consolidation smoothing method for constructing an underwater riprap foundation which includes a first region for supporting comparatively high load applied thereto from a structure such as a caisson and a second region positioned adjacent the first region for supporting comparatively low load applied thereto from mulch blocks or the like and wherein the first region is formed as a rigid riprap core wall body having a consolidation density higher than that in the second region and the first region and the second region have top faces which are flush with each other, comprising the steps of throwing ripraps into water such that the extra-banking height in the first region is higher than that in the second region, and repetitively carrying out free fall of a weight to the first region and the second region to consolidate the ripraps in the first and second regions so that the top faces thereof are smoothed.

With the underwater riprap foundation consolidation smoothing method, since ripraps are thrown into water such that the extra-banking height in the first region for supporting comparatively high load applied thereto is higher than that in the second region for supporting comparatively low load applied thereto and free fall of a weight to the first region and the second region is repetitively carried out to consolidate the ripraps in the first and second regions to a planned top face height so that the top faces thereof are smoothed, only it is required to throw a necessary and sufficient amount of ripraps into the first region similarly as in the prior art but to throw a reduced smaller amount of ripraps than ever into the second region. Therefore, the amount of ripraps required as a whole decreases, and the cost for construction can be reduced.

Preferably, the free fall of the weight to the first region is first carried out repetitively to consolidate the ripraps in the first region to form the riprap core wall body, and then the free fall of the weight to the second region is carried out repetitively from a boundary of the second region to the riprap core wall body toward a face of slope of the underwater riprap foundation to consolidate and smooth the ripraps in the second region.

With the underwater riprap foundation consolidation smoothing method, since the free fall of the weight to the first region is first carried out repetitively to consolidate the ripraps in the first region to form the riprap core wall body and then the free fall of the weight to the second region is carried out repetitively from a boundary of the second region to the riprap core wall body toward a face of slope of the underwater riprap foundation to consolidate and smooth the ripraps in the second region, the ripraps in the second region do not force up to the riprap core wall body side. Consequently, the necessity to perform a consolidation smoothing operation again for the region for which the consolidation smoothing is completed, and therefore, the efficiency in construction is improved when compared with that of the prior art.

Preferably, the number of times by which the weight is released to fall freely per unit area of the second region is smaller than the number of times by which the weight is released to fall freely per unit area of the first region.

With the underwater riprap foundation consolidation smoothing method, since the number of times by which the weight is released to fall freely per unit area of the second region is smaller than the number of times by which the weight is released to fall freely per unit area of the first region, the efficiency in construction is high and the cost for construction can be reduced economically.

The above and other objects, features and advantages of the present invention will become apparent from the following description and the appended claims, taken in conjunction with the accompanying drawings in which like parts or elements are denoted by like reference symbols.

DESCRIPTION OF THE PREFERRED EMBODIMENT

Figure 5:
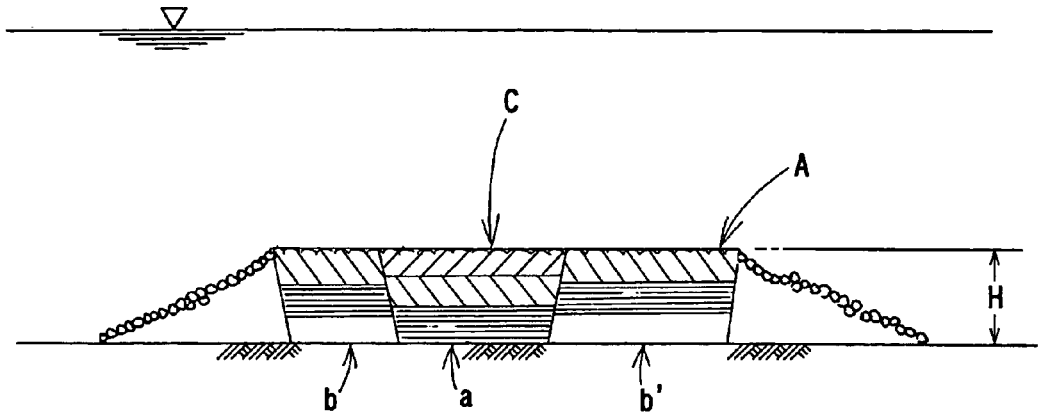
FIG. 5 is a similar view but showing the underwater riprap foundation after the consolidation smoothing is completed.

Referring first to FIG. 5, there is shown an underwater riprap foundation to which the present invention is applied. The underwater riprap foundation includes a first region a for supporting comparatively high load applied thereto from a structure such as a caisson placed thereon, and a second region b or b' positioned adjacent the first region a for supporting comparatively low load applied thereto from mulch blocks E or the like. The first region is formed as a rigid riprap core wall body C having a consolidation density higher than that in the second region b or b'. Further, the first region a and the second region b or b' have top faces which are flush with each other.

Figure 1:
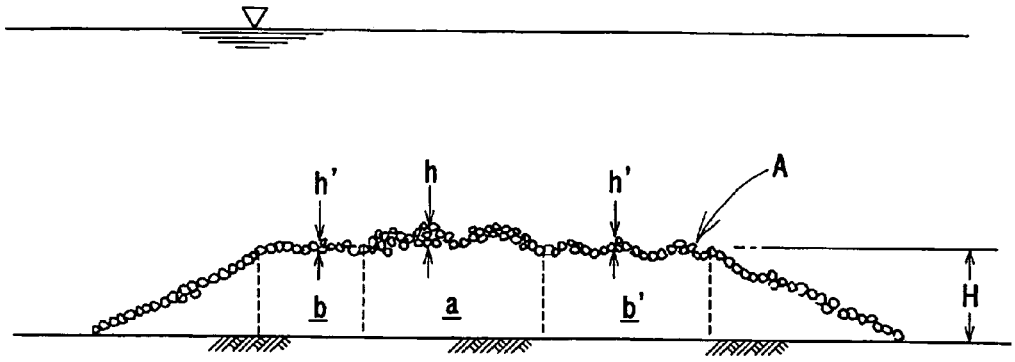
FIG. 1 is a schematic sectional view showing an underwater riprap foundation formed by piling up of a required amount of ripraps on the bottom of the water according to an underwater riprap foundation consolidation smoothing method to which the present invention is applied.

According to the present invention, the underwater riprap foundation described above is constructed in the following manner. In particular, referring to FIG. 1, according to the underwater riprap foundation consolidation smoothing method to which the present invention is applied, a large number of middle crushed stones having a size of approximately 20 to 50 cm and a weight of approximately 30 to 300 kg are thrown as ripraps into the water and piled up on the bottom of the water to form a riprap foundation A of a trapezoidal transverse section having faces of slope on the opposite sides thereof in the widthwise direction and having a height greater by a required extra-banking height than a planned top end height H.

In this instance, the ripraps are thrown into the water such that the extra-banking height h of a horizontal portion of the riprap foundation A within a region a within which a structure such as a caisson which provides a high load is to be supported, may be approximately 20 to 50 cm while the extra-banking height h' within regions b and b' which are positioned outwardly of the opposite sides of the region a and within which mulch blocks or like elements which provide a low load are to be supported is approximately 10 to 20 cm.

According to a conventional underwater riprap foundation consolidation smoothing method, the extra-banking height is approximately 20 to 50 cm over an overall area of the riprap foundation A. In contrast, according to the underwater riprap foundation consolidation smoothing method of the present embodiment, since the extra-banking height in the regions b and b' are set lower as described above, the amount of ripraps to be used can be reduced as much and reduction of the cost for construction can be achieved.

The top face of the riprap foundation A formed in such a manner as described above indicates a state of a rough face on which ripraps project here and there, and the porosity of the riprap foundation A is approximately 40%.

Then, the top face of the riprap foundation A is roughly smoothed in the following manner.

In particular, as a first step, a weight B (refer to FIG. 2 and so forth) hung on a boom not shown of a crane of a crane ship through a wire is placed once on the top face of the riprap foundation A to measure the height of the riprap foundation A at the place at which the weight B is placed. Then as a second step, the weight B is lifted to a required height and then released to freely fall thereby to smooth the ripraps projecting on the upper face of the riprap foundation A. The two steps are alternately performed repetitively.

Since the height of the riprap foundation A can be calculated from the positional relationship between the water level and a graduation marked on an outer face of an upper portion of the weight B placed on the upper face of the riprap foundation A, the height of tide and so forth, the height from which the weight B is to be released to freely fall is determined based on the measured values.

It is to be noted that, according to a trial calculation, when a weight B having a weight of 43 tons and having a square bottom face of 2.5 m×2.5 m is lifted by 1 m and released to freely fall, force of approximately 180 tons can be applied to ripraps, and when the weight B is lifted by 2 m and released to freely fall, force of approximately 250 tons can be applied.

Since the top face of the riprap foundation A is a concave and convex face from which ripraps project here and there as described hereinabove, the weight B placed on the top face of the riprap foundation A is inclined in a certain direction if it rides on a riprap projecting on the top face of the riprap foundation A.

Accordingly, if the weight B placed on the top face of the riprap foundation A is inclined, then the weight B is lifted and the boom of the crane is moved upwardly or downwardly and turned horizontally to move in a direction opposite to the direction in which the weight B was inclined until the weight B is positioned above the riprap, and then the weight B is released from a height determined suitably to freely fall to smooth the riprap.

Such a sequence of operations as described above is carried out repetitively while successively displacing the smoothing position outwardly on the opposite sides of the riprap foundation A from the center in the widthwise direction, that is, from the region a to the region b or b' through upward or downward movement and horizontal turning movement of the boom and, if necessary, through movement of the crane ship.

In this manner, the top face of the riprap foundation A is smoothed to a substantially horizontal face, for example, to such a degree that the weight B placed on the top face of the riprap foundation A stands uprightly even if the wire of the boom is slackened.

Thereafter, finish smoothing of the region a is performed.

Figure 2:
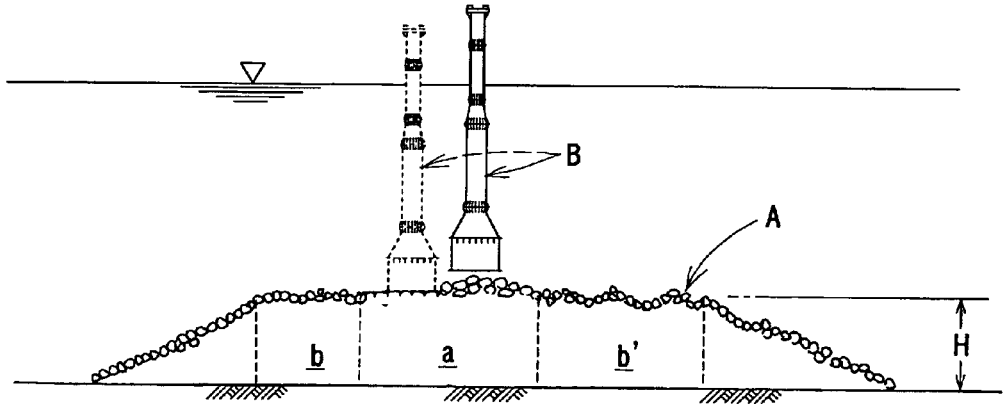
FIG. 2 is a similar view but showing the underwater riprap foundation in a state wherein consolidation smoothing in a region within which the load is high is being performed.

The finish smoothing includes a step of confirmation of the height of the riprap foundation A which is performed with the weight B placed on the top face of the riprap foundation A and another step of consolidation smoothing by free fall of the lifted weight B. The steps are carried out repetitively and alternately while successively moving the boom upwardly and downwardly and horizontally turning the boom to displace the smoothing position (FIG. 2).

For the finish smoothing operation of the region a, such a method is not used that the height at a particular place is finished to a planned top end height H once and then the range within which the height is finished in this manner is gradually and successively increased, but a different method is used. In particular, the height over the overall area of the region a is consolidated uniformly and successively, for example, by approximately 10 cm until the height in the overall area of the region a finally becomes equal to the planned top end height H. However, an error of approximately ±5 cm may be permitted.

Thereupon, care is taken so that the height of the riprap foundation A may not become lower than the planned top end height H as a result of excessive consolidation.

For example, when the weight B is released from a fixed height to fall freely, if the riprap foundation A is consolidated excessively beyond an assumed amount, then the falling height in a succeeding cycle should be set lower. On the other hand, if the consolidation is insufficient, then the falling height in a succeeding cycle should be set higher.

Figure 3:
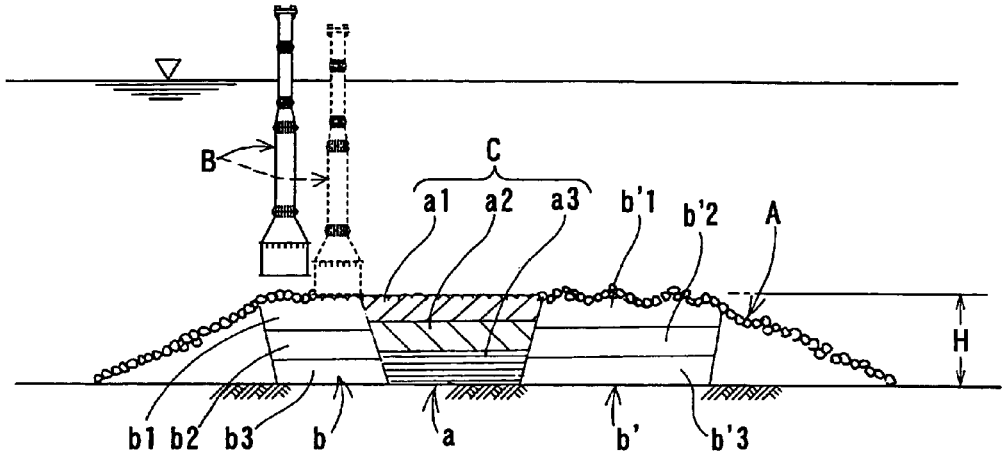
FIG. 3 is a similar view but showing the underwater riprap foundation in another state wherein consolidation smoothing in a region within which the load is low is being performed.

The ripraps in the region a are consolidated while moving downwardly or obliquely downwardly outwardly by the finish smoothing so that the ripraps are engaged with each other to form a solid riprap core wall body C as seen in FIG. 3. In the riprap core wall body C, the porosity in an upper layer a1 is substantially 25 to 30% and the porosity in a middle layer a2 is substantially 30 to 35% while the porosity in a lower layer a3 is approximately 35 to 38%. In other words, a higher layer exhibits a higher degree of consolidation. Further, the riprap core wall body C has an inverted trapezoidal transverse section wherein the width of the upper layer a1 is greater than that of the middle layer a2 while the width of the middle layer a2 is greater than the lower layer a3.

If the riprap core wall body C is left as it is for one to two days after it is formed, then the ripraps are engaged further firmly with each other to raise the force of friction therebetween thereby to place the riprap core wall body C into a further solidified and stabilized state. Consequently, the riprap core wall body C can stably support a structure having a high weight, and also the settlement of the structure constructed on the riprap core wall body C such as a caisson is small.

Thereafter, finish smoothing of the regions b and b' which are adjacent the riprap core wall body C formed in the region a and receives lower load applied thereto is performed.

The finish smoothing operation of the regions b and b' is preferably performed after the riprap core wall body C is placed into a further solidified and stabilized state through rest time of one to two days after the finish smoothing of the region a.

Figure 4:
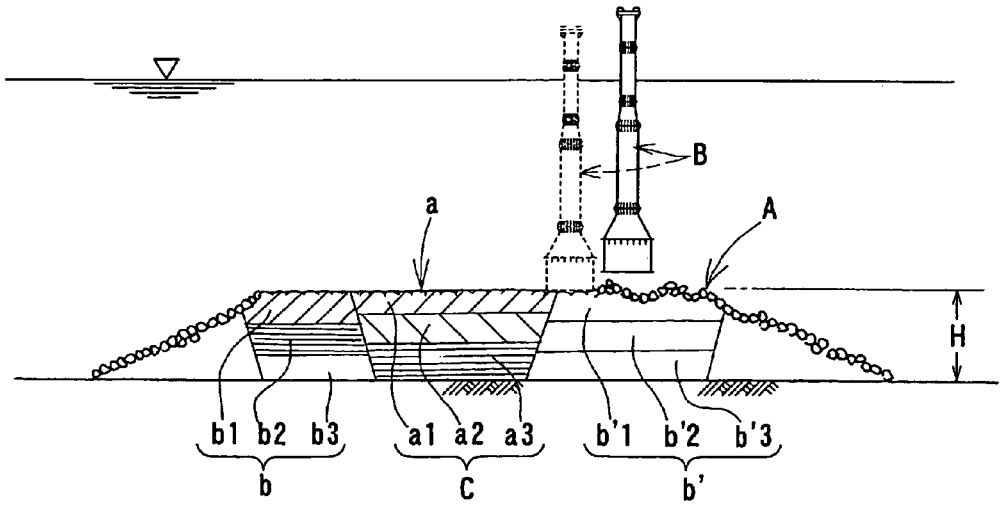
FIG. 4 is a similar view but showing the underwater riprap foundation in a further state wherein consolidation smoothing in another region within which the load is low is being performed.

The finish smoothing of the regions b and b' includes repetitive and alternative executions of a step of confirmation of the height of the riprap foundation A performed with the weight B placed on the riprap foundation A and a step of consolidation smoothing through free fall of the lifted weight B similarly as in the finish smoothing of the region a. However, the finish smoothing of the regions b and b' is performed successively after the smoothing position is successively displaced in a direction from the boundary to the riprap core wall body C toward a face of slope as seen in FIGS. 3 and 4.

The allowance in dimension with respect to the planned top end height H is set greater to approximately ±30 cm than that in the case of the finish smoothing of the region a.

The regions b and b' are positioned adjacent the riprap core wall body C and the consolidation therein is performed beginning with the boundary thereof to the riprap core wall body C. Therefore, the ripraps consolidated in the regions b and b' are engaged with each other to reduce the porosity while they are pressed toward the face of slope of the riprap foundation A.

Accordingly, forcing up of ripraps toward the riprap core wall body C does not occur, and there is no necessity to perform a smoothing operation again for a forced up region after finish smoothing is performed as in the conventional underwater riprap foundation consolidation smoothing method. Thus, a better operation efficiency can be achieved.

Further, in the regions b and b', since the extra-banking of ripraps is lower and the allowance in dimension is approximately ±30 cm and greater than those in the region a, the height from which the weight B is to be released to fall freely may be smaller than that in the finish smoothing in the region a and also the number of times of free fall required for a unit area may be smaller. Accordingly, the operation can be performed in a considerably higher efficiency than ever and the cost for construction can be reduced.

Through the finish smoothing, the regions b and b' come to have the height H equal to that of the region a, that is, the riprap core wall body C, and have a top face flush with the top face of the region a. It is to be noted, however, that an error of approximately ±30 cm is permitted as described hereinabove.

Although, in the regions b and b', a higher layer has a higher degree of consolidation density, upper layers b1 and b'1, middle layers b2 and b'2 and lower layers b3 and b'3 have lower consolidation densities when compared with those of the layers a1 to a3 of the adjacent riprap core wall body C.

More particularly, although the upper layers b1 and b'1 are consolidated to a porosity of approximately 30 to 35% and the middle layers b2 and b'2 are consolidated to another porosity of approximately 35 to 38%, the lower layers b3 and b'3 are little consolidated because a falling impact of the weight B does not have a much influence on the lower layers b3 and b'3.

Finally, the faces of slope are subject to a smoothing operation by means of a weight or a small winch of an underwater craft, a manual smoothing operation of a diver or a like operation. Construction of the riprap foundation A is completed thereby as seen in FIG. 5.

Figure 6:
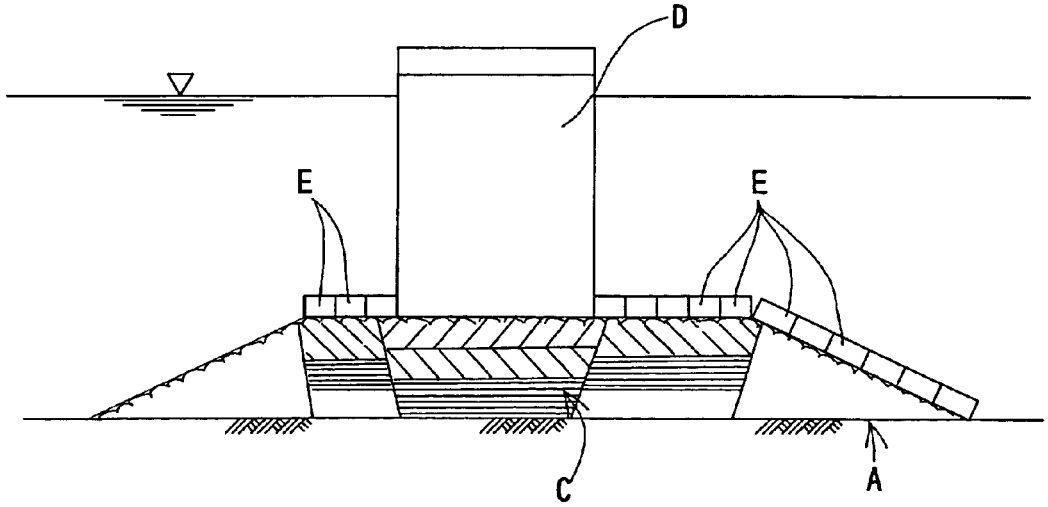
FIG. 6 is a similar view but showing the underwater riprap foundation on which a structure is constructed and mulch blocks are laid.

Thereafter, a structure D such as caisson is constructed on the top face of the riprap core wall body C, and mulch blocks E and so forth are laid on the top faces of the regions b and b' and the faces of slope, whereby construction of a mole, a quay or the like is completed as seen in FIG. 6.

While a preferred embodiment of the present invention has been described using specific terms, such description is for illustrative purposes only, and it is to be understood that changes and variations may be made without departing from the spirit or scope of the following claims.

What is claimed is:

1. An underwater riprap foundation consolidation smoothing method for constructing an underwater riprap foundation which includes a first region for supporting comparatively high load applied thereto from a caisson structure and a second region positioned adjacent said first region for supporting comparatively low load applied thereto from mulch blocks and wherein said first region is formed as a rigid riprap core wall body having a consolidation density higher than that in said second region and said first region and said second region have top faces which are flush with each other, comprising the steps of:

throwing ripraps into water such that the extra-banking height in the first region is higher than that in the second region; and repetitively carrying out free fall of a weight to the first region and the second region to consolidate the ripraps in the first and second regions up to a planned height for the top end so that the top faces thereof are smoothed.

2. An underwater riprap foundation consolidation smoothing method as claimed in claim 1, wherein the free fall of the weight to the first region is first carried out repetitively to consolidate the ripraps in the first region to form the riprap core wall body, and then the free fall of the weight to the second region is carried out repetitively from a boundary of the seconf region to the riprap core wall body toward a face of slope of said underwater riprap foundation to consolidate and smooth the ripraps in the second region.

3. An underwater riprap foundation consolidation smoothing method as claimed in claim 1, wherein the number of times by which the weight is released to fall freely per unit area of the second region is smaller than the number of times by which the weight is released to fall freely per unit area of the first region.

* * * * *

UNITED STATES PATENT AND TRADEMARK OFFICE

CERTIFICATE OF CORRECTION

PATENT NO. : 6,997,649 B1
APPLICATION NO. : 11/028336
DATED : February 14, 2006
INVENTOR(S) : Kiyoshi Saito It is certified that error appears in the above-identified patent and that said Letters Patent is hereby corrected as shown below:

In Column 8:
Line 30, "seconf" should be read as --second--.

Signed and Sealed this

Twenty-third Day of January, 2007

JON W. DUDAS
*Director of the United States Patent and Trademark Office*